US005977861A

United States Patent [19]

Duggal et al.

[11] Patent Number: 5,977,861

[45] **Date of Patent: *Nov. 2, 1999**

[54] CURRENT LIMITING DEVICE WITH GROOVED ELECTRODE STRUCTURE

[75] Inventors: Anil Raj Duggal; Minyoung Lee; Lionel Monty Levinson, all of Niskayuna, N.Y.

[73] Assignee: General Electric Company, Schenectady, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/811,669

[22] Filed: Mar. 5, 1997

[51] Int. Cl.[6] ..... H01C 7/10

[52] U.S. Cl. ..... 338/22 R; 338/114; 338/112

[58] Field of Search ..... 338/324, 328, 338/314, 22 R, 112, 114, 115, 47, 20, 21; 361/126, 135

[56] References Cited

U.S. PATENT DOCUMENTS

| | | | |
|---|---|---|---|
| 2,278,072 | 3/1942 | Gould et al. | 338/328 |
| 2,382,024 | 8/1945 | Priessman | 338/195 |
| 3,226,600 | 12/1965 | Zielasek | 315/209 |
| 3,243,753 | 3/1966 | Kohler | 338/31 |
| 3,648,002 | 3/1972 | Du Rocher | 200/166 C |
| 3,673,121 | 6/1972 | Meyer | 252/511 |
| 4,017,715 | 4/1977 | Whitney et al. | 219/553 |
| 4,101,862 | 7/1978 | Takagi et al. | 338/23 |
| 4,107,640 | 8/1978 | Asano et al. | 338/23 |
| 4,180,901 | 1/1980 | Kulwicki | 29/621 |
| 4,237,441 | 12/1980 | van Konynenburg et al. | 338/22 R |

(List continued on next page.)

FOREIGN PATENT DOCUMENTS

| | | | |
|---|---|---|---|
| 0640995 | 3/1995 | European Pat. Off. . | |
| 0713227 | 5/1996 | European Pat. Off. . | |
| 0747910 | 12/1996 | European Pat. Off. . | |
| 4330607 | 3/1995 | Germany . | |
| 115408 | 7/1926 | Switzerland | 338/324 |
| 9112643 | 8/1991 | WIPO . | |
| 9119297 | 12/1991 | WIPO . | |
| 9321677 | 10/1993 | WIPO . | |
| 9410734 | 5/1994 | WIPO . | |
| 9534931 | 12/1995 | WIPO . | |
| 9749102 | 12/1997 | WIPO . | |

OTHER PUBLICATIONS

Duggal et al., Appl. Phys. Lett. 71 (14), Oct. 6, 1997, "High Power Switching Behavior in Electrically Conductive Polymer Composite Materials", pp. 1939–1941.

Ford et al., J. Appl. Phys. 61 (6), Mar. 15, 1987, Positive Temperature Coefficient Resistors as High–Power Pulse Switches: Performance Limitations, Temperature Effects, and Triggering Behavior, pp. 2381–2385.

Duggal et al., Journal of Applied Physics, vol. 83, No. 4, Feb. 15, 1998, The Initiation of High Current Density Switching in Electrically Conductive Polymer Composite Materials, pp. 2046–2051.

Duggal et al., J. Appl. Phys. 82 (11), Dec. 1, 1997, A Novel High Current Density Switching Effect in Electrically Conductive Polymer Composite Materials, pp. 5532–5539.

*Primary Examiner*—Lincoln Donovan
*Assistant Examiner*—Karl Easthom
*Attorney, Agent, or Firm*—Ernest G. Cusick; Noreen C. Johnson

[57] ABSTRACT

A current limiting device utilizes an electrically conductive composite material and an inhomogeneous distribution of resistance structure. The current limiting device has a conducting filler and at least two electrodes, where at least one of the electrodes comprises a grooved electrode structure. The grooved electrode structure maintains contact between the electrodes and the composite material, even with consumption of the composite material and production of residue during a high current condition.

14 Claims, 5 Drawing Sheets

U.S. PATENT DOCUMENTS

| | | | |
|---|---|---|---|
| 4,292,261 | 9/1981 | Kotani et al. | 264/24 |
| 4,304,987 | 12/1981 | van Konynenburg | 219/553 |
| 4,314,231 | 2/1982 | Walty | 338/328 |
| 4,317,027 | 2/1982 | Middleman et al. | 219/553 |
| 4,330,704 | 5/1982 | Jensen | 219/553 |
| 4,445,026 | 4/1984 | Walker | 219/553 |
| 4,583,146 | 4/1986 | Howell | 361/13 |
| 4,685,025 | 8/1987 | Carlomagno | 361/106 |
| 4,890,186 | 12/1989 | Matsubara et al. | 361/103 |
| 4,959,632 | 9/1990 | Uchida | 338/22 R |
| 5,057,674 | 10/1991 | Smith-Johannsen | 219/553 |
| 5,068,634 | 11/1991 | Shrier | 338/21 |
| 5,166,658 | 11/1992 | Fang et al. | 338/23 |
| 5,247,276 | 9/1993 | Yamazaki | 338/22 R |
| 5,260,848 | 11/1993 | Childers | 361/127 |
| 5,313,184 | 5/1994 | Greuter et al. | 338/21 |
| 5,382,938 | 1/1995 | Hansson et al. | 338/22 R |
| 5,414,403 | 5/1995 | Greuter et al. | 338/22 R |
| 5,416,462 | 5/1995 | Demarmels et al. | 338/22 R |
| 5,432,140 | 7/1995 | Sumpter et al. | 502/167 |
| 5,436,274 | 7/1995 | Sumpter et al. | 521/88 |
| 5,451,919 | 9/1995 | Chu et al. | 338/22 R |
| 5,545,679 | 8/1996 | Bollinger, Jr. et al. . | |
| 5,581,192 | 12/1996 | Shea et al. | 324/722 |
| 5,602,520 | 2/1997 | Baiatu et al. | 338/22 R |
| 5,644,283 | 7/1997 | Grosse-Wilde et al. | 338/20 |
| 5,777,541 | 9/1998 | Vekeman . | |

CURRENT LIMITING DEVICE WITH GROOVED ELECTRODE STRUCTURE

BACKGROUND OF THE INVENTION

1. Field of the Invention

This invention relates to current limiting devices for general circuit protection including electrical distribution and motor control applications. In particular, the invention relates to current limiting devices that are capable of limiting the current in a circuit when a short-circuit or high current condition occurs.

2. Description of Related Art

There are numerous devices that are capable of limiting the current in a circuit when a high current condition occurs. One known limiting device includes a filled polymer material that exhibits what is commonly referred to as a PTCR (positive-temperature coefficient of resistance) or PTC effect. U.S. Pat. No. 5,382,938, U.S. Pat. No. 5,313,184, and European Published Patent Application No. 0,640,995 A1 each describe electrical devices relying on PTC behavior. The unique attribute of the PTCR or PTC effect is that at a certain switch temperature the PTCR material undergoes a transformation from a basically conductive material to a basically resistive material. In some of these prior current limiting devices, the PTCR material (typically polyethylene loaded with carbon black) is placed between pressure contact electrodes.

U.S. patent application Ser. No. 08/514,076, filed Aug. 11, 1995, now U.S. Pat. No. 5,614,881, issued Mar. 25, 1997, the entire contents of which are herein incorporated by reference, discloses a current limiting device. This current limiting device relies on a composite material and an inhomogeneous distribution of resistance structure.

Current limiting devices are used in many applications to protect sensitive components in an electrical circuit from high fault currents. Applications range from low voltage and low current electrical circuits to high voltage and high current electrical distribution systems. An important requirement for many applications is a fast current limiting response to minimize the peak fault current that develops.

In operation, current limiting devices are placed in a circuit to be protected. Under normal circuit conditions, the current limiting device is in a highly conducting state. When a high current condition occurs, the PTCR material heats up through resistive heating until the temperature is above the "switch temperature." At this point, the PTCR material resistance changes to a high resistance state and the high current condition current is limited. When the high current condition is cleared, the current limiting device cools down over a time period, which may be long, to below the switch temperature and returns to the highly conducting state. In the highly conducting state, the current limiting device is again capable of switching to the high resistance state in response to future high current condition events.

Known current limiting devices comprise conductive composite material and standard flat electrodes that have generally planar surfaces, a low pyrolysis or vaporization temperature polymeric binder and an electrically conducting filler combined with an inhomogeneous distribution of resistance structure. The switching action of these current limiting devices occurs when joule heating of the electrically conducting filler in the relatively higher resistance part of the composite material causes sufficient heating to cause pyrolysis or vaporization of the binder.

During operation of known current limiting devices, at least one of material ablation and arcing occur at localized switching regions in the inhomogeneous distribution of resistance structure. The ablation and arcing can lead to at least one of high mechanical and thermal stresses on the conductive composite material. These high mechanical and thermal stresses often lead to the mechanical failure of the composite material. For a reliable operation, it is desirable to reduce high mechanical and thermal stresses.

Further, the ablation and arcing often produce a non-conducting, or at least a poorly conducting, residue from the expended filler. This residue, comprises various ablation products, and is located at an interface between the standard flat electrode and conductive composite material of the current limiting device after a switching event. This residue is undesirable since it is believed to increase the overall resistance of the current limiting device. The residue is distributed over the interface, so as to impair the overall operation of the current limiting device due to the added resistance. Since a current limiting device should have as low a resistance as possible, especially after a switching event, and have small an area as possible, the increased resistance, due to the residue, limits uses of current limiting devices with standard flat electrodes.

SUMMARY OF THE INVENTION

Accordingly, it is advantageous to provide a current limiting device that overcomes the above, and other, disadvantages of current limiting devices.

In accordance with the invention, it is desirable to provide a current limiting device with at least one grooved electrode structure, which allows a lower steady-state device resistance for large contact area devices, than compared to a standard flat electrode structure.

In accordance with one embodiment of the invention a current limiting device comprises at least two electrodes, where at least one of the at least two electrodes comprises a grooved electrode structure. An electrically conductive composite material is disposed between the at least two electrodes and contacting the grooved electrode structure. The at least two electrodes and composite material are in contact at interfaces between the at least two electrodes and composite material.

DETAILED DESCRIPTION OF THE INVENTION

Figure 1:
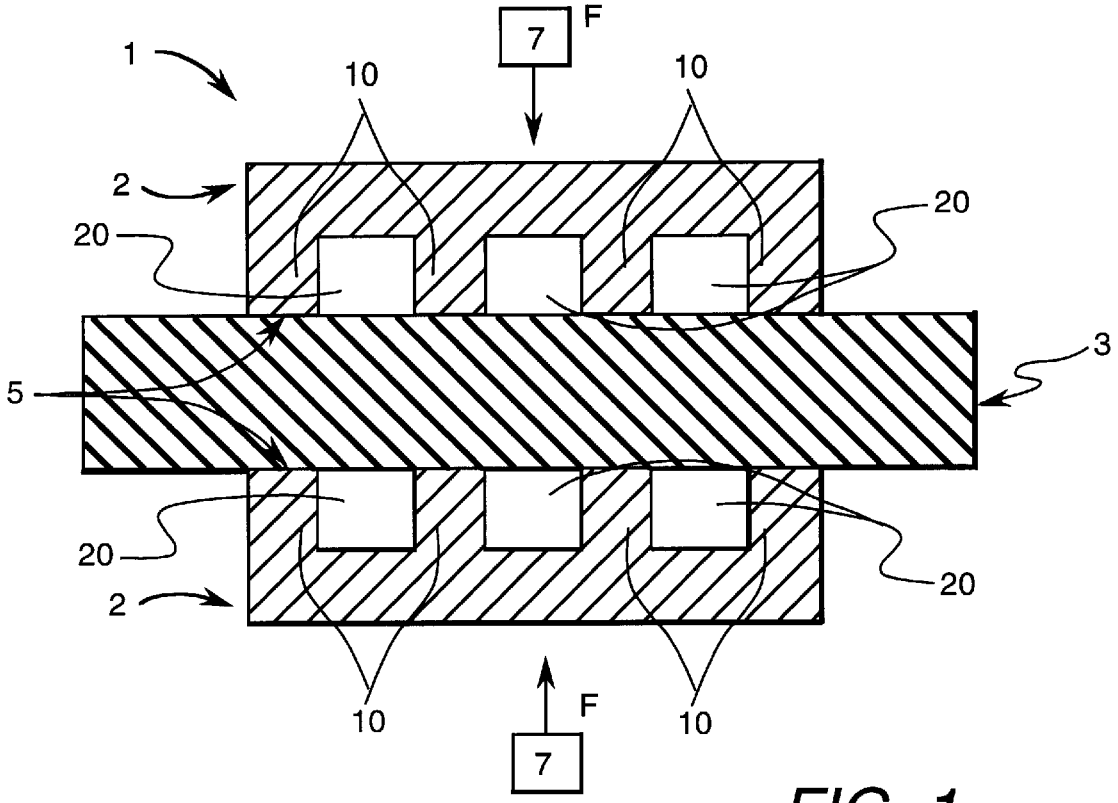
FIG. 1 is a side schematic drawing of an embodiment of a current limiting device.

Current limiting devices should attain a relatively low resistance steady state after a switching event has been completed, as is known in the art. Many current limiting devices require as low a steady state resistance as possible, to minimize steady state power dissipation that occurs in a circuit. One known method to minimize steady state power dissipation and to lower resistance in current limiting devices to increase an area of a current limiting device, while holding all other structural features of the current limiting device constant. In such cases, the resistance of the current limiting device decreases proportionally to the increase in the area in the current limiting device.

However, some current limiting devices utilizing a polymer, equipped with standard flat electrodes, do not exhibit the ability to attain a relatively low resistance steady state after a switching event has been completed. In current limiting devices with a relatively large area, for example with standard flat electrodes, a steady state resistance can be significantly higher than expected, when compared to the expected inverse relationship. Therefore, for current limiting devices with standard flat electrodes, a non-scaling relationship between resistance and area can be exhibited. Since a desirable current limiting device has as low a resistance as possible after a switching event and as small an area as possible, the observed non-scaling relationship between area and resistance limits applications of current limiting devices with standard flat electrodes.

The non-scaling of area versus resistance in current limiting devices with standard flat electrodes is believed to be attributed to a build-up both vaporous and solidus of ablated products, also known as residue, ablated products at at least one switching interface between electrodes and conductive composite materials. In current limiting devices, a switching interface is designed at at least one of the interfaces between the electrode and composite material.

Ablated products are formed in a central region of an interface during a switching event. With a relatively small area current limiting device, the created ablated products are believed to be relatively close to an edge of the interface due to the small size of the current limiting device. Therefore, ablated products in a small area current limiting device can be blown away from the region during further operation, for example, by subsequent arcing and ablation.

However, for standard flat electrodes, as the area of the interface between the electrode and the conducting polymer material increases, a distance between a central region and edge of the interface increases. Accordingly, it is highly likely that created ablated products are trapped and retained in the central region. Therefore, it appears that more non-conducting ablated products are present at the interface between the electrode and the conducting polymer material for current limiting devices with larger areas. This increased amount of non-conducting solid ablated products is believed to lead to a higher resistance rather than that expected from the normally exhibited inverse relationship between area and resistance.

A polymer current limiting device 1, as embodied in the invention, is illustrated in FIG. 1. The current limiting device 1 comprises at least one grooved electrode structure 2 and a conductive composite material 3. It is preferable that the current limiting device 1 comprise all of its electrodes as grooved electrode structures 2. The current limiting device 1 further comprises at least one interface 5 between the at least one grooved electrode structure 2 and the conductive composite material 3.

Each grooved electrode structure 2 comprises at least one projection 10 and at least one groove 20 at an interface 5 with the conductive composite material 3. Preferably, each grooved electrode structure 2 comprises a plurality of projections 10 and a plurality of grooves 20 in an alternating configuration at the interface 5, thus defining channels. Any number of grooves 20 and projections 10 can be provided with the grooved electrode structure 2, as in embodied in the invention, and the illustrated configuration is merely exemplary. The following description will discuss a grooved electrode structure, that description pertains to each grooved electrode structure in a current limiting device.

At the interface 5, there are alternating regions of contact with the grooved electrode structure 2, and alternating regions of no contact with the grooved electrode structure 2. These regions of contact are at least regions of mechanical and electrical contact, and occur at projections 10 of the grooved electrode structure 2. The alternating regions of no contact occur at grooves 20 of the grooved electrode structure 2.

The projection 10, which is at least physically and electrically attached to a conductive plate, as described above and embodied in the invention, is formed from any appropriate material that exhibits conductive behavior, including but not limited to metals, semiconductor, ceramics and other known materials. The scope of the invention thus comprises grooved electrode structures, with at least one projection and groove, where the at least one projection and groove are of any geometric size and shape, and formed in any appropriate manner.

The size, number, shape and configuration of the channels at least one projection and at least one groove are not critical as long as a spacing distance between grooves is small enough to ensure that most of the ablated product P is believed to move and "escape" from the contact region at the projections, and are deposited into the no contact regions at the grooves. The depth of each groove should be large and deep enough to accommodate ablated products P, and not have the ablated products P contact the conductive composite material, as discussed in detail hereinafter. The above descriptions are merely exemplary and are not meant to limit the invention in any way.

The current limiting device 1 further comprises a higher resisting portion of inhomogeneous resistance structure at the regions of contact, at the projections 10, between the grooved electrode structure 2 and conductive composite material 3. Accordingly, during a high current condition, a switching event is instigated at, and confined to, the interface 5.

Figure 2:
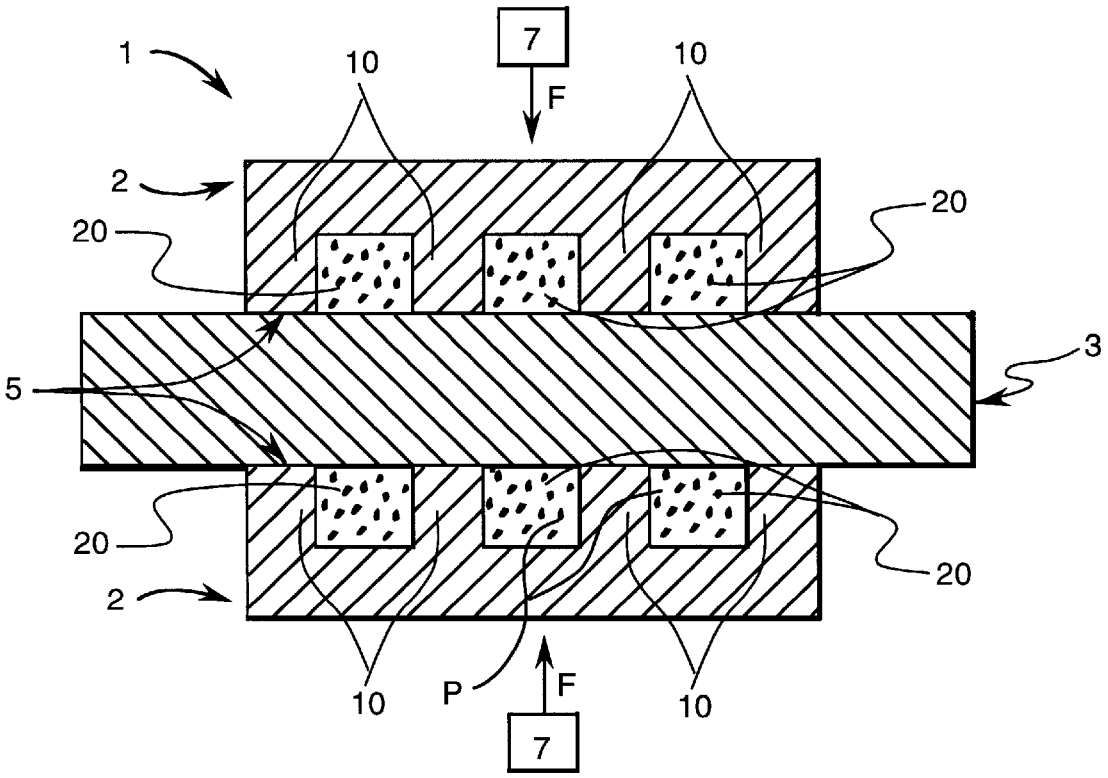
FIG. 2 is a side schematic drawing of a current limiting device illustrating non-conducting residue.

The operation of a current limiting device 1, as embodied in the invention and illustrated in FIG. 2, will now be discussed. The current limiting device 1 is placed in an electrical circuit (not illustrated). Arcing and ablation processes occur during a switching event and cause the conductive composite material 3 to be vaporized and consumed. This vaporization and consumption form ablated products P from the conductive composite material 3.

A portion of the conductive composite material 3 is consumed by the arcing and ablation process associated with the switching event, and produces ablated products P, alternatively referred to as residue. It is believed that if the solid ablated products P are positioned at between the conductive composite material 3 and the grooved electrode structure 2 at the projections 10 so as to effectively separate and insulate projections 10 from the conductive composite material 3, the resistance of the current limiting device 1 is increased, and the overall effectiveness of the current limiting device is diminished.

In a current limiting device 1, as embodied by the invention, the ablated products P are created at the interface 5 between the grooved electrode structure 2 and the conductive composite material 3. The ablated products P are believed to be then moved, for example, by forces associated with a subsequent switching event, such as mechanical and thermal forces that result from a switching event, so the ablated products P accumulate in the grooves 20 of the grooved electrode structure 2. Therefore, there is no significant reduction of contact between the grooved electrode structure 2 and the conductive composite material 3 at the interface 5.

Accordingly, with accumulation of the ablated products P in the grooves 20, it is believed that the solid ablated products P do not prevent contact between the conductive composite material 3 and the grooved electrode structure 2 at the projections 10. Thus, with ablated products P accumulated in the grooves 20, the current limiting device 1 maintains sound contact between the conductive composite material 3 and the grooved electrode structure 2 at the projections 10 at the interface 5. The overall resistance of the current limiting device 1 is not increased, and the operation of the current limiting device 1 is not impaired.

As discussed above, the ablated products P formed by the vaporization and consumption of the conductive composite material 3 occur with a switching event. With a flat electrode structure, the ablated products P are confined to the interface of a current limiting device, and increase the overall resistance of the current limiting device. However, with the grooved electrode structure 2, as embodied in the invention, ablated products P formed during switching at regions of contact at the projections 10 are believed to be accumulated in the grooves 20, as a result of subsequent switching events. Accordingly, with a grooved electrode structure 2 in a current limiting device 1, the overall resistance is not increased, and a desirable operation consistent with the expected inverse relationship of electrode area and resistance is obtained.

The conductive composite material 3, which is a polymer, comprises at least one of low pyrolysis and a vaporization temperature binder, and an electrically conducting filler combined with an inhomogeneous distribution of resistance structure, and electrodes. The binder is chosen so that significant gas evolution occurs at a low, i.e. less than about 800° C., temperature.

The current limiting device 1 is under a force F of compressive pressure in a direction perpendicular, to a selected thin high resistance layer. The force F resulting in the pressure is applied by a force applying device 7. Alternatively, the force F may be inherent in the current limiting device 1, and an external force applying device 7 need not be used in a current limiting device.

Figure 4:
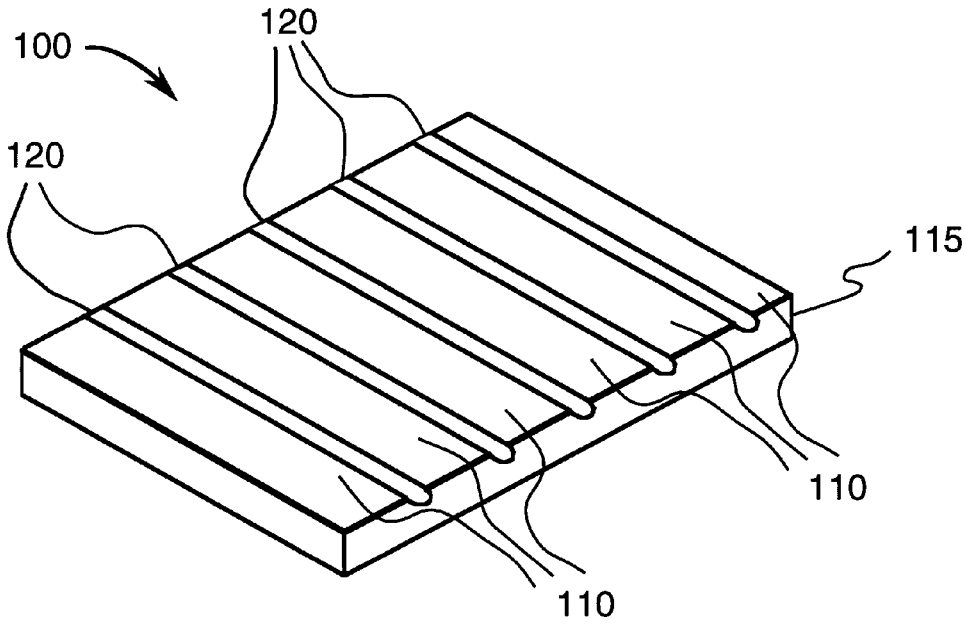
FIG. 4 is a bottom perspective view of a first embodiment of a current limiting device with a grooved electrode structure.

The grooved electrode structure 2 is constructed to present an alternating arrangement of at least one groove 20 and at least one projection 10. However, the exact configuration of the at least one groove 20 and at least one projection 10 in the grooved electrode structure 2 is not critical, as long as an alternating arrangement of at least one groove 20 and at least one projection 10 is present. By way of example but not limiting, as embodied in FIG. 4, a grooved electrode structure 100 is formed by scribing separated and distinct grooves 120 on a bottom surface of a electrode 115 so as to define at least one groove 120 and at least one projection 110. This construction thus defines a grooved electrode structure 100 comprising at least one projection 110 and at least one groove 120.

Figure 5:
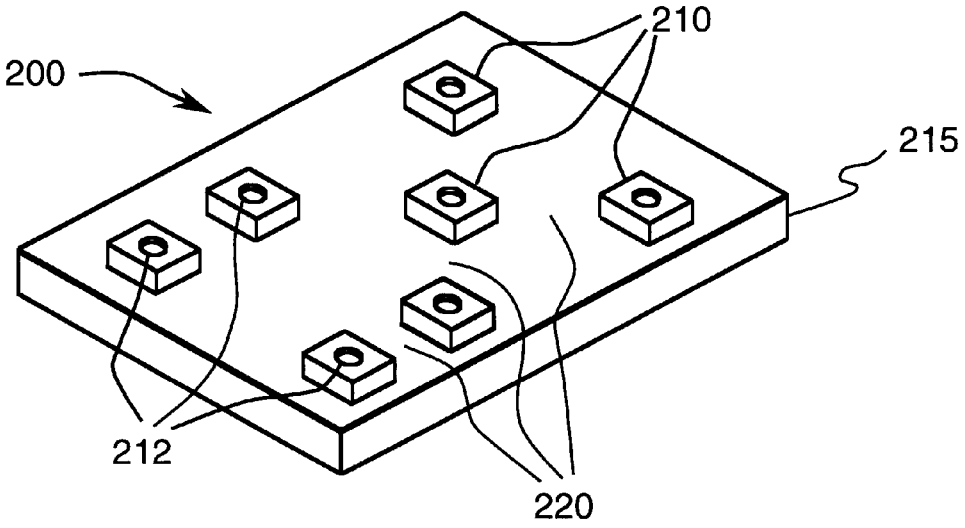
FIG. 5 is a bottom perspective view of a second embodiment of a current limiting device with a grooved electrode structure.

Alternatively, as embodied in FIG. 5, a grooved electrode structure 200 comprises at least one device 212 that mechanically attaches separate and distinct projections 210, of any geometric size and shape, onto a bottom surface of a conductive plate 215. A space between the attached projections 210 defines a groove 220. This construction thus defines a grooved electrode structure 200 comprising at least one projection 210 and at least one groove 220. The at least one projection 210 is attached to the conductive plate 215 by any appropriate device and manner, including, but not limited to, mechanical connectors, adhesives, tapes, glues and other known mechanical connectors. Although FIG. 5 illustrates one device 212, any number of devices 212 can be used in a grooved electrode structure depending on its intended use.

Figure 6:
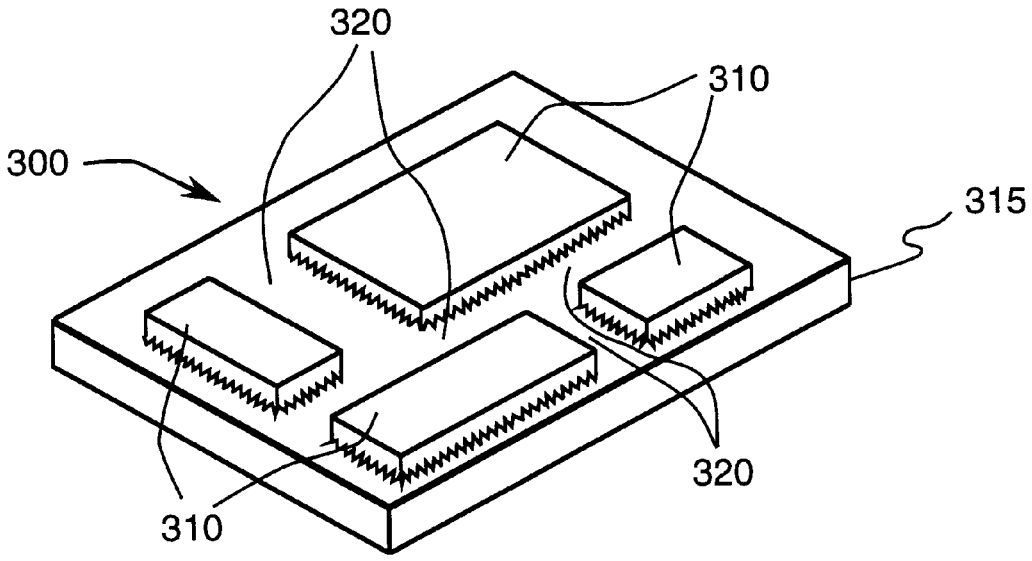
FIG. 6 is a bottom perspective view of a third embodiment of a current limiting device with a grooved electrode structure.

Further as embodied in FIG. 6, a grooved electrode structure 300 is formed by metallurgically attaching, for example by welding at weld 312, at least one separate and distinct projection 310, of any geometric size and shape, onto a bottom surface of a conductive plate 315, where a space between the projections 310 defines a groove 320. This configuration defines the grooved electrode structure 300 comprising at least one projection 310 and at least one groove 320.

Figure 7:
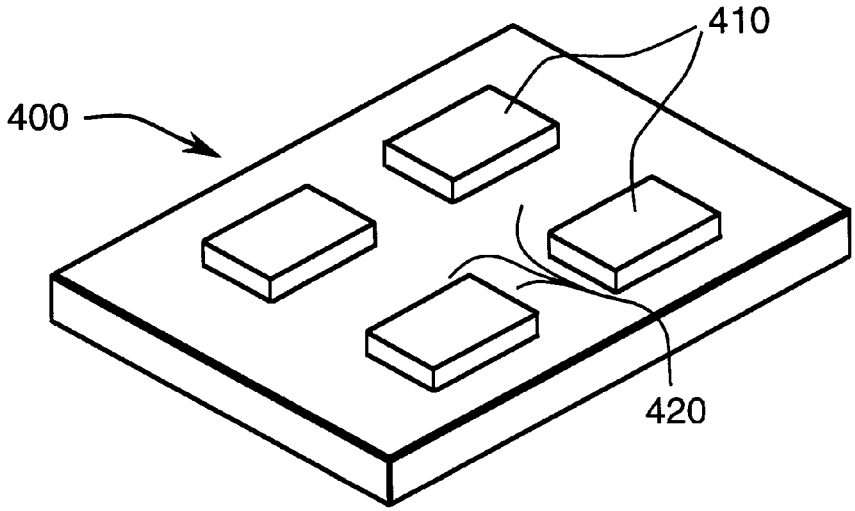
FIG. 7 is a bottom perspective view of a fourth embodiment of a current limiting device with a grooved electrode structure.

Furthermore, as embodied in FIG. 7, a grooved electrode structure 400 is formed by unitarily and integrally molding, as a single piece element, a grooved electrode structure to have at least one separate projection 410 and at least one separate groove 420. The at least one separate projection 410 and at least one separate groove 420 have any geometric size, configuration and shape. This construction thus defines a grooved electrode structure 400 comprising at least one projection 410 and at least one groove 420.

Figure 8:
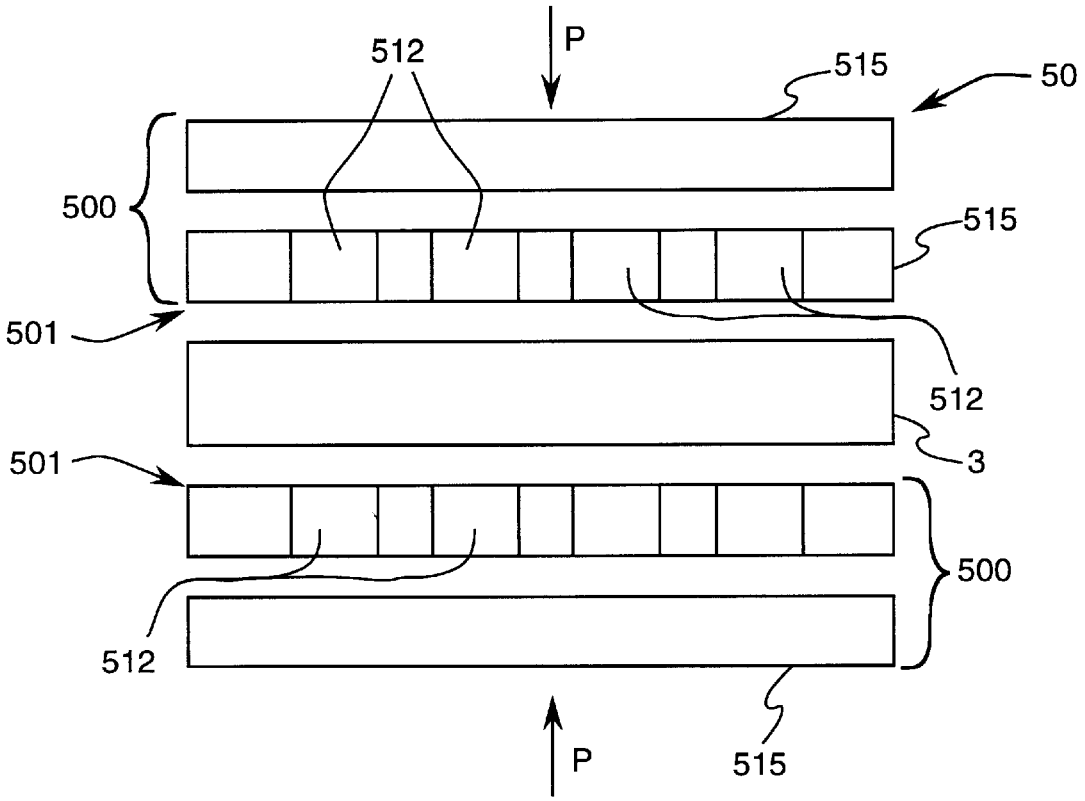
FIG. 8 is a side cross sectional view of a fifth embodiment of a current limiting device with a grooved electrode structure.
Figure 9:
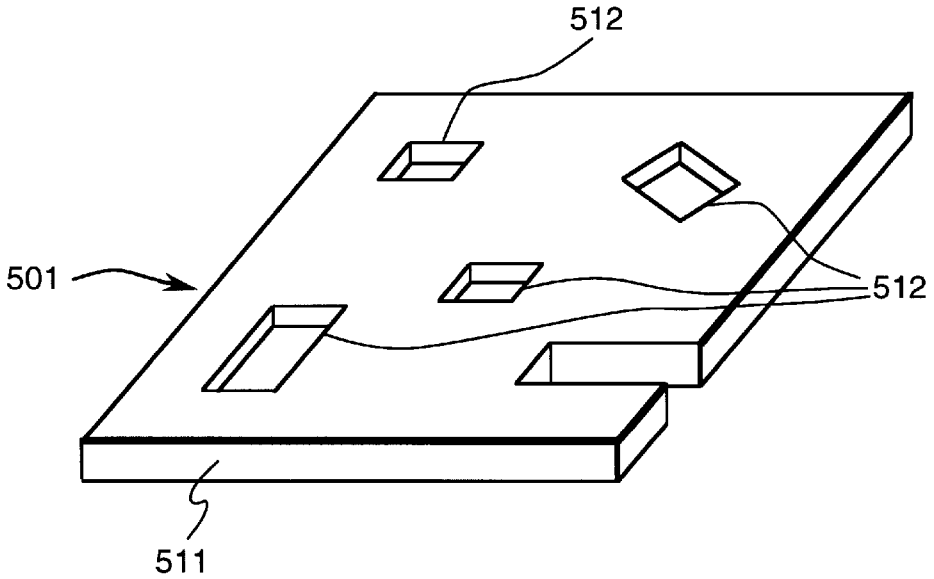
FIG. 9 is a bottom perspective view of a the fifth embodiment of a current limiting device with a grooved electrode structure.

As in a further embodiment of a current limiting device 50, as embodied in the invention, as illustrated in FIGS. 8 and 9, a grooved electrode structure is 500 is formed in a multi-component construction. The grooved electrode structure 500 comprises at least one and preferably two honeycombed electrodes 501 and solid electrode backing plates 515, both of which surround a conductive composite material 3. The honeycombed electrodes 501 are formed from a piece of conductive material 511 with voids 512 formed in flat piece of conductive material 511. This configuration defines grooves at the voids 512 and projections 513 over the remainder of the flat piece of conductive material 511 at the regions without the voids 512.

The construction of the grooved electrode structure 500, as embodied in FIGS. 8 and 9, is merely exemplary of the various configurations of the voids 512 and the resultant projections 513 possibilities. The orientation, shape and size of the voids 512 in the flat piece of conducting material 511 take any appropriate form, depending on the intended use of the current limiting device and the overall environment of the current limiting device. Further, the voids 512 formed in flat piece of conducting material 511 are formed by any suitable process, such as but not limited to punching, molding, cutting, etching and similar processes.

The conductive composite material 3 comprises a polymeric conductive composite material. The composite material comprises at least one of a low pyrolysis vaporization temperature binder and an electrically conducting filler combined with inhomogeneous distributions of resistance structure that may be under compressive pressure. The binder should be chosen such that significant gas evolution occurs at a low (about approximately <800° C.) temperature. The inhomogeneous distribution structure is typically chosen so that at least one selected thin layer of the current limiting device has much higher resistance than the rest of the current limiting device.

Alternate constructions of the current limiting device can be made by a parallel current path containing a resistor, varistor, or other linear or nonlinear elements to achieve goals, such as controlling the maximum voltage that may appear across the current limiting device in a particular circuit. Further, an alternative path can be provided for some of the circuit energy to increase the usable lifetime of the current limiting device.

A binder material for use in the polymer conducting material can comprise a low pyrolysis or vaporization temperature (<800 C.), such as: a thermoplastic, for example, polytetrafluoroethylene, poly(ethyleneglycol), polyethylene, polycarbonate, polyimide, polyamide, polymethylmethacrylate, and polyester; a thermoset plastic, for example, epoxy, polyester, polyurethane, phenolic, and alkyd; an elastomer, for example, silicone (polyorganosiloxane), (poly)urethane, isoprene rubber, and neoprene; an organic or inorganic crystal; alone or combined with an electrically conducting filler, such as a metal, for example, nickel, silver, silver and aluminum and copper; or a semiconductor, for example, carbon black, and titanium dioxide could also perform effectively in the current limiting device of the invention. Further, the binder material with a particulate or foam structure is also envisioned in the invention.

Third phase fillers can be added in the current limiting device to improve specific properties of the composite. In the invention, these third phase fillers comprise fillers to improve mechanical properties; dielectric properties; or to provide arcquenching properties or flame-retardant properties. Materials that could be used as a third phase fillers in the conductive composite material comprise: a filler selected from reinforcing fillers, such as fumed silica; or extending fillers, such as precipitated silica and mixtures thereof. Other fillers include titanium dioxide, lithopone, zinc oxide, diatomaceous silicate, silica aerogel, iron oxide, diatomaceous earth, calcium carbonate, silazane treated silicas, silicone treated silicas, glass fibers, magnesium oxide, chromic oxide, zirconium oxide, alpha-quartz, calcined clay, carbon, graphite, cork, cotton sodium bicarbonate, boric acid, and alumina-hydrate.

Other additives may be included in the current limiting device. These comprise at least impact modifiers for preventing damage to the current limiting device, such as cracking upon sudden impact; flame retardants for preventing flame formation and inhibiting flame formation in the current limiting device; dyes and colorants for providing specific color components in response to customer requirements; UV screens for preventing reduction in component physical properties due to exposure to sunlight or other forms of UV radiation.

The current limiting device, as embodied in the invention, could be utilized in a plurality of circuits. These include circuits with parallel linear or nonlinear circuit element(s), such as for example (but not limited to) resistor(s) or varistor(s). The instant invention also contemplates that with current limiting devices electrically conducting materials other than metals, such as but not limited to ceramics and intrinsically conductive polymers, can be used for conductive features of the invention.

Three polymer current limiting devices were constructed to support a premise of the invention. The three current limiting devices were test current limiting devices and subjected to electrical test conditions to determine a relationship between area and resistance. The first current limiting device was a conventional current limiting device with a relatively small contact area that was used to determine a standard inverse relation between area and resistance. The second current limiting device was a current limiting device with a large area flat electrode. The third current limiting device was a current limiting device constructed with a grooved electrode structure, as embodied in the invention.

In each of the test current limiting devices, a polymer conductive composite material, which comprised an epoxy matrix and a nickel filler, were used. However, this example and the following descriptions are merely exemplary, and are not meant to limit the invention in any way.

The first test current limiting device comprised a piece of composite material placed between two silver-plated copper electrodes. The electrodes were placed under pressure by a force applying device.

The second test current limiting device comprised a piece of polymer conductive composite material, which was placed between two flat silver-plated copper electrodes. These silver-plated copper electrodes were placed under pressure by a force applying device.

The third test current limiting device was constructed with a grooved electrode structure, as embodied in the invention. The third current limiting device comprised a piece of polymer conductive composite material. The polymer conductive composite material was sandwiched between two grooved electrode structures, which were placed under pressure by a force applying device (not illustrated).

The grooved electrode structure of the third test current limiting device as embodied in the invention, is similar to the grooved electrode structure illustrated in FIG. 5, and comprises about individual silver generally discs, which form the projections, and the resultant grooves. Although FIG. 5 illustrates four discs, any number of discs can be used in the invention, depending of the environment and intended use of the current limiting device. These discs were connected, for example by soldering, at soldered joint onto a flat plate, where the plate is formed from a conductive material, such as but not limited to copper. The silver discs were placed approximately equidistant from each other with a minimal appropriate separation between nearest neighbor centers.

For all three test current limiting devices, static pressure holding the electrodes to the composite material by a force applying device. Further, the three test current limiting devices then were subjected to predetermined electrical conditions to determine a relationship between area and resistance.

The first test current limiting device was subject to ten voltage square pulses, each pulse being approximately 400V, using an appropriate amplifier system. The first test current limiting device switched to a high resistance state during each pulse, and then recovered a low steady state resistance after the square pulse was over. The results form the first test current limiting device are characteristic of most current limiting devices, due to its conventional construction and relatively small electrode area.

Figure 3:
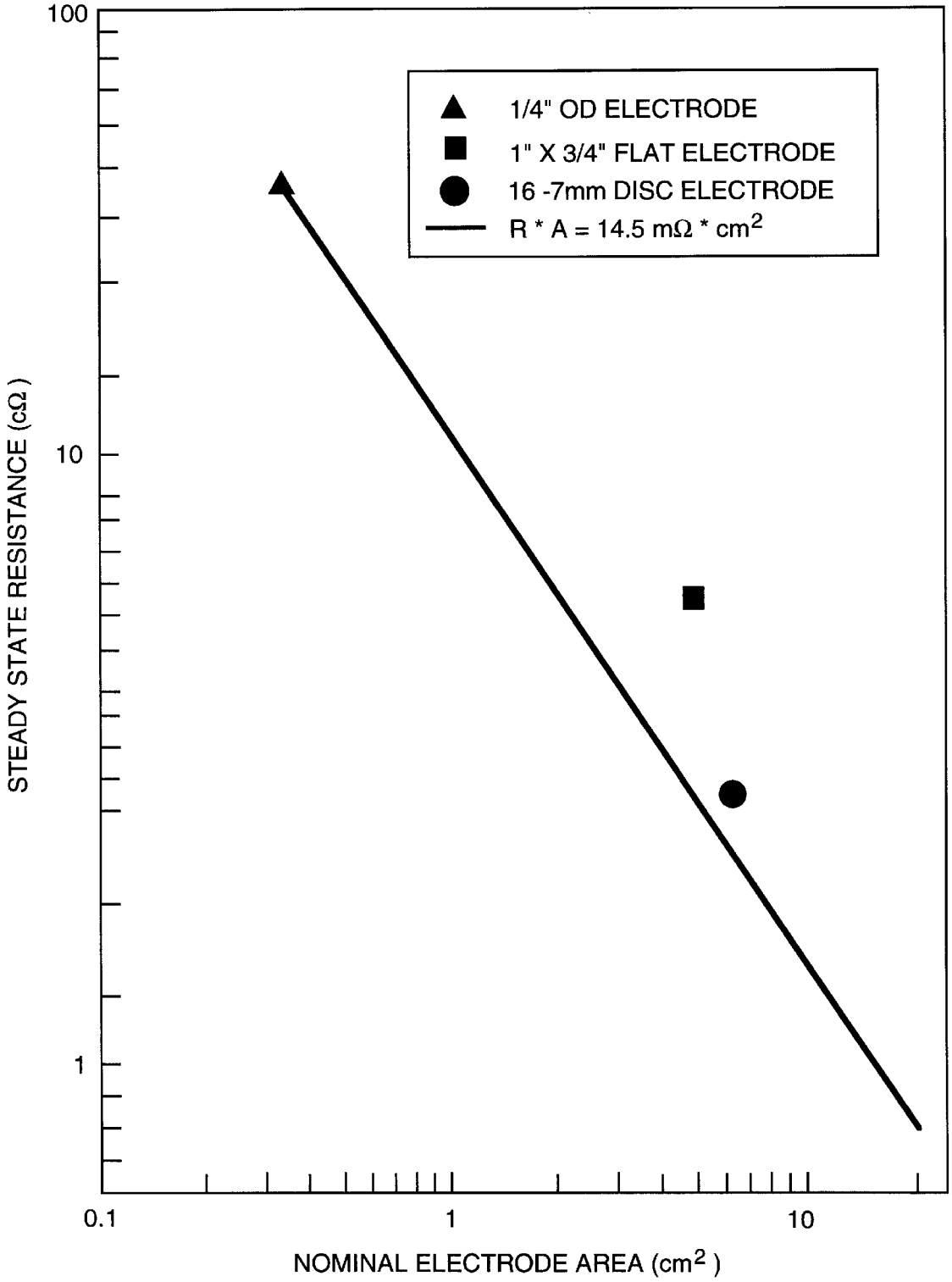
FIG. 3 is a graph of a resistance versus area for current limiting devices.

The nominal total contact area of the electrodes for the first test current limiting device was determined to be approximately 0.316 $cm^2$ and the observed average resistance is approximately 45.8 mΩ (triangle symbol in FIG. 3). From these results, an inverse linear relationship, which is used to predict resistance for other test current limiting devices with varying areas, is determined as set forth in Equation (1):

$$R*A=14.5\ m\Omega*cm^2 \quad (1)$$

where R is an average resistance and A is a nominal contact area. Equation (1) is plotted in FIG. 3 as a solid line.

The second and third test current limiting devices were subject to four separate high current condition events in an approximately 277 V RMS (root mean square) circuit with an available current of approximately 60,000 A. Both the second and third test current limiting devices switched to a high resistance state during the high current condition, and then recovered a low steady state resistance when the high current condition was eliminated.

For each test current limiting device, a low steady state resistance was attained after each switching event. An average value for each current limiting device is plotted in FIG. 3, as a function of a nominal total contact area for each device.

The measured average resistance for the second test current limiting device with flat electrodes and third test current limiting device with grooved electrode structure are plotted in FIG. 3. As illustrated, the second test current limiting device, with the large area flat electrode, exhibits a resistance that is over a factor of two times larger than predicted by Equation (1).

The third test current limiting device, with the grooved electrode structure exhibits a resistance which is within about 30% of the predicted resistance of Equation (1). Accordingly, a current limiting device with a grooved electrode structure generally follows the expected and predictable inverse relation between area and resistance, with the area and resistance approximately inversely related. Thus, a lower overall resistance is obtained with a grooved electrode structure, compared to a flat electrode structure, where the areas of the respective electrodes are generally the same.

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

What is claimed is:

1. A current limiting device comprising:

at least two electrodes, at least one of the at least two electrodes comprising a grooved electrode structure, the grooved electrode structure comprising at least one groove and at least one projection alternating with the at least one groove, each groove and respective projections define at least one channel;

an electrically conductive composite material disposed between said at least two electrodes and contacting said grooved electrode structure at the at least one projection while being spaced from the grooved electrode structure at the at least one groove, defining alternating contact regions between the electrically conductive composite material and the grooved electrode structure, and alternating no-contact regions between the electrically conductive composite material with the grooved electrode structure, whereby, during a short circuit, resistive heating causes ablation, rapid thermal expansion and vaporization of the electrically conductive composite material, the ablation producing at least solid ablated products; and means for applying a force to the at least two electrodes to provide contact between the at least two electrodes and the electrically conductive composite material at the contact regions;

wherein said at least two electrodes and said composite material are in contact at interfaces between said at least two electrodes and said composite material and define a current limiting device resistance, wherein each at least one grooved electrode structure accommodates the solid ablated products, so contact at the interfaces is returned without solid ablated products interfering with the contact between the at least two electrodes and said composite material and without reducing the current limiting device resistance.

2. The device according to claim 1, the grooved electrode structure comprises a plurality of discs spaced from one another, the disc defining the at least one groove and the at least one projection.

3. The device according to claim 2, the plurality of discs are spaced equidistant from one another.

4. The device according to claim 2, the grooved electrode structure further comprising a generally flat conductive plate and wherein the plurality of discs spaced are attached to the flat plate.

5. The device according to claim 4, wherein the plurality of discs comprise silver and the flat conductive plate comprises copper.

6. The device according to claim 4, further comprising at least one connector for each disc, the at least one connector attaching a disc to the flat conductive plate.

7. The device according to claim 4, wherein each disc is attached to the flat conductive plate by at least one weld.

8. The device according to claim 4, wherein each disc is integrally and unitarily molded, as one piece, with the flat conductive plate.

9. The device according to claim 8, wherein each projection is formed by scribing the generally flat conductive plate to form the at least one groove.

10. The device according to claim 1, the grooved electrode structure comprises at least one honeycombed electrode and at least one solid electrode backing plate, the electrode backing plate being in connection with the honeycombed electrode.

11. The device according to claim 10, the honeycombed electrode comprises a conductive plate with voids formed in the generally flat conductive plate to define the at least one groove at the voids and the at least one projection.

12. The device according to claim 1, further comprising an inhomogeneous distribution of resistance structure between the at least two electrodes.

13. A method of switching a current limiting device, the current limiting device comprises at least two electrodes, at least one of the at least two electrodes comprising a grooved electrode structure, the grooved electrode structure comprising at least one groove and at least one projection alternating with the at least one groove; an electrically conductive composite material disposed between said at least two electrodes and contacting said grooved electrode structure at the at least one projection while being spaced from the grooved electrode structure at the at least one groove, and defining alternating contact regions between the electrically conductive composite material and the grooved electrode structure, and alternating no-contact regions between the electrically conductive composite material with the grooved electrode structure; whereby, during a short circuit, resistive heating causes ablation, rapid thermal expansion and vaporization of the electrically conductive composite material, the ablation producing at least solid ablated products; and means for applying a force to the at least two electrodes to provide the contact between the at least two electrodes and the electrically conductive composite material at the contact regions; the method comprises:

providing the current limiting device;

subjecting the current limiting device to a switching event, the switching event, vaporizing and consuming the electrically conductive composite material of the current limiting device and forming gaseous and solid ablated products; and accommodating the gaseous and solid ablated products in the no-contact regions so that the electrically conductive composite material and the grooved electrode structure contact each other at the contact regions therebetween, wherein the solid ablated products do not interfere with the contact between the at least two electrodes and the electrically conductive composite material and do not reduce a current limiting device resistance.

14. A method according to claim 13, wherein the step of accommodating comprises moving the ablated products by forces generated by a subsequent switching event.

* * * * *